US008511462B2

(12) United States Patent
Mezzini

(10) Patent No.: US 8,511,462 B2
(45) Date of Patent: Aug. 20, 2013

(54) MULTI-PRODUCT PACKET

(76) Inventor: Sergio Mezzini, Pianoro (IT)

( * ) Notice: Subject to any disclaimer, the term of this patent is extended or adjusted under 35 U.S.C. 154(b) by 0 days.

(21) Appl. No.: 12/864,689

(22) PCT Filed: Jan. 29, 2009

(86) PCT No.: PCT/IB2009/000188

§ 371 (c)(1),
(2), (4) Date: Jul. 27, 2010

(87) PCT Pub. No.: WO2009/095783

PCT Pub. Date: Aug. 6, 2009

(65) Prior Publication Data

US 2010/0307932 A1 Dec. 9, 2010

(30) Foreign Application Priority Data

Feb. 1, 2008 (IT) ..... BO20084000070

(51) Int. Cl.
*B65D 83/00* (2006.01)
*B65D 83/04* (2006.01)
*B65D 85/60* (2006.01)

(52) U.S. Cl.
USPC ..... 206/38; 206/800; 206/538

(58) Field of Classification Search
USPC ..... 206/38, 102, 237, 248, 256, 258, 206/263, 261, 264, 528, 538, 800, 37; 229/120.02, 120.03, 122
See application file for complete search history.

(56) References Cited

U.S. PATENT DOCUMENTS

| | | | | | |
|---|---|---|---|---|---|
| 879,851 | A | * | 2/1908 | Bonnell | 222/192 |
| 919,659 | A | * | 4/1909 | Weber | 206/237 |
| 1,390,866 | A | * | 9/1921 | Barac | 206/92 |
| 1,506,926 | A | * | 9/1924 | Gunter | 383/40 |
| 1,541,506 | A | * | 6/1925 | Jack | 206/237 |
| 1,599,132 | A | * | 9/1926 | Hodgson | 206/94 |
| 2,011,399 | A | * | 8/1935 | Driscoll | 206/237 |
| 2,447,787 | A | * | 8/1948 | Atkinson | 206/92 |
| 2,809,747 | A | * | 10/1957 | Fowler, Jr. | 206/95 |
| 2,944,555 | A | * | 7/1960 | Peel et al. | 131/238 |
| 2,958,417 | A | * | 11/1960 | Adams | 206/246 |
| 2,975,890 | A | | 3/1961 | Block | |
| 3,028,950 | A | * | 4/1962 | Content | 206/246 |
| 3,090,482 | A | * | 5/1963 | Sandacz | 206/246 |
| 3,112,029 | A | * | 11/1963 | Davey | 206/246 |
| 4,789,059 | A | * | 12/1988 | Kim | 206/246 |
| 5,242,057 | A | * | 9/1993 | Cook et al. | 206/581 |
| 5,927,488 | A | * | 7/1999 | Gray | 206/237 |
| 6,138,822 | A | * | 10/2000 | Garcia | 206/246 |
| 6,170,655 | B1 | * | 1/2001 | Hill | 206/237 |
| 6,467,614 | B1 | | 10/2002 | Tallier et al. | |

(Continued)

FOREIGN PATENT DOCUMENTS

| | | |
|---|---|---|
| EP | 0 960 831 A1 | 12/1999 |
| EP | 1 803 662 A1 | 7/2007 |

OTHER PUBLICATIONS

International Search Report, dated Sep. 18, 2009, from corresponding PCT application.

*Primary Examiner* — Steven A. Reynolds
(74) *Attorney, Agent, or Firm* — Young & Thompson

(57) ABSTRACT

A packet for containing at least two products of different kinds. According to particular aspects of the invention, the second product is located in a compartment separate from the first and easily accessible so that the user can take it out and, if necessary, put it back into the packet.

18 Claims, 7 Drawing Sheets

(56) References Cited

U.S. PATENT DOCUMENTS 6,923,315 B2 * 8/2005 Lo Duca ..... 206/232
7,490,734 B2 * 2/2009 Carr ..... 221/102
7,870,953 B2 * 1/2011 Tanbo et al. ..... 206/268
2007/0193892 A1 * 8/2007 Tanbo et al. ..... 206/205

* cited by examiner

MULTI-PRODUCT PACKET

TECHNICAL FIELD

This invention relates to a multi-product packet. In particular, the packet according to the invention may be used to package a first product, such as chewing gum, and a second product, such as wrapping papers in which the chewing gum can be placed after use.

BACKGROUND ART

Known in the prior art are chewing gum packets comprising a paperboard box containing the chewing gum and a pack of paper pieces used to dispose of the chewing gum properly after use. When the chewing gum has been used, the user opens the packet, takes out the group of paper pieces, removes one from the group and wraps the used chewing gum in it and then puts the rest of the paper pieces back into the packet.

This leads to problems of hygiene because the paper pieces come into direct contact with the chewing gum and are put back into the box with the hands after wrapping up the gum that has just been chewed. Also known are chewing gum packets consisting of a plastic box where the group of paper pieces is kept in a pocket on the outside of the box, closed by a separate lid.

Although this solution overcomes the above mentioned problems, its production costs and environmental impact are extremely high.

DISCLOSURE OF THE INVENTION

This invention therefore provides a packet comprising an outer container body, in particular in the form of a box-shaped body, made preferably of paperboard or other foldable material, for containing a first product, where said container body has a plurality of walls and an internal compartment for containing a second product and formed on the inside of said walls, the packet being characterized in that a zone is provided for dispensing the second product from the internal compartment through one of the walls of the outer container body. In this way, the user can take the second product out of the packet without having to touch the first product. Further, the packet thus obtained has a cost comparable to that of packet designed to contain only one product, is similar in size and has a low environmental impact.

BRIEF DESCRIPTION OF THE DRAWINGS

These and other characteristics of the invention may be clearly inferred from the preferred embodiments described below purely by way of example and without limiting the scope of protection.

DETAILED DESCRIPTION OF THE PREFERRED EMBODIMENTS OF THE INVENTION

Figure 1:
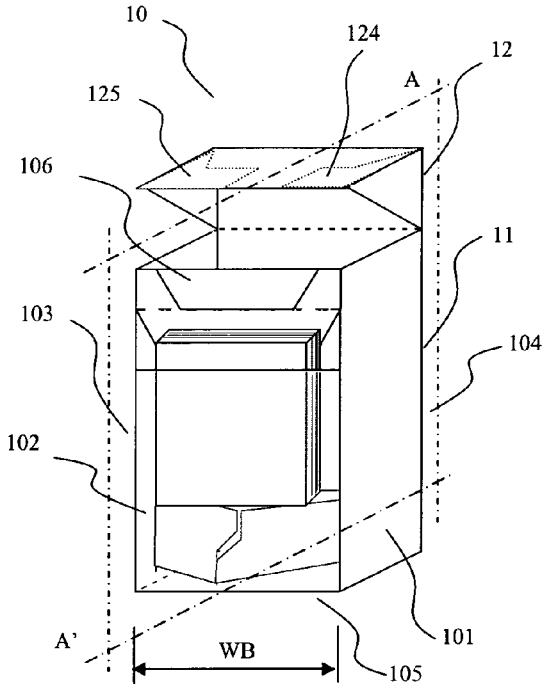
FIG. 1 illustrates a first preferred embodiment of the packet.

FIGS. 1 to 9 show a first preferred embodiment 10 of the packet according to the invention, comprising an outer container body, in particular in the form of a box-shaped body 11, made preferably of paperboard or other foldable material, and provided with lateral product containment means in the form of a plurality of peripheral walls that delimit a box-shaped body with a rectangular base. Although the rectangular shape is especially preferred, a container body whose base has another polygonal shape or includes curvilinear sides is also imaginable.

In particular, this box-shaped body 11 comprises two main sidewalls, namely a front sidewall 102 and a rear sidewall 104, opposite each other and equal in area to the other walls of the packet, and two secondary, left- and right-hand sidewalls 101, 103, joined permanently to the front wall 102 and to the rear wall 104.

Figure 3:
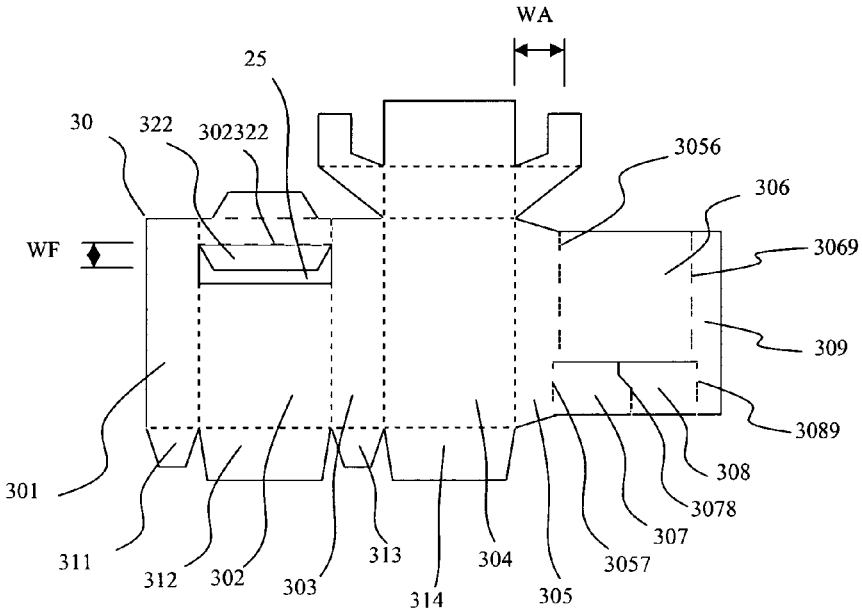
FIG. 3 is a plan view of the blank used to make the first preferred embodiment of the packet.
Figure 4:
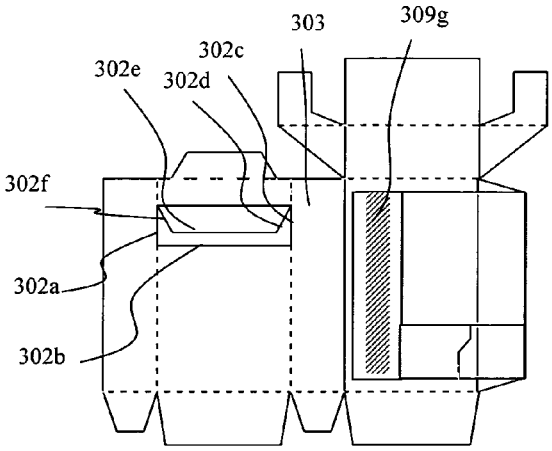
FIG. 4 is a plan view showing the blank used to make the first preferred embodiment of the packet, partly folded before pre-gluing.
Figure 5:
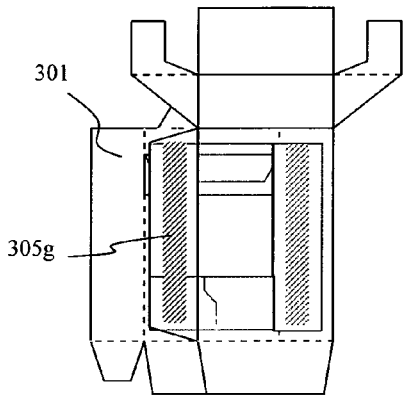
FIG. 5 is a plan view showing the blank used to make the first preferred embodiment of the packet, partly folded and pre-glued.
Figure 6:
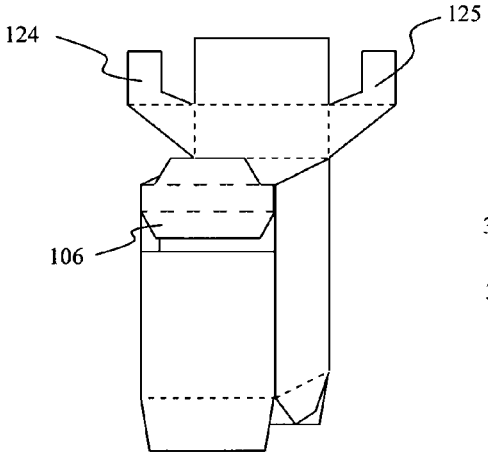
FIG. 6 is a perspective view showing the first preferred embodiment of the packet after being pre-glued and erected and before the products have been placed in it.

This packet is obtained from the blank 30 shown in FIG. 3, by suitably folding the blank and gluing the panel 303 to the corresponding front gluing zone 309*g* of the panel 309. Then, as illustrated in FIGS. 4 and 5, the blank is folded again and the panel 301 is glued to the corresponding rear gluing zone 305*g* on the back of the panel 305.

The panel 302 forms the front wall 102, the panel 303 forms the sidewall 103 and the panel 304 forms the rear wall 104, while the sidewall 101 is formed by the two panels 301 and 305 joined to each other by the gluing means 305*c*.

At this stage the blank is normally referred to by experts in the trade as being pre-glued.

Figure 7:
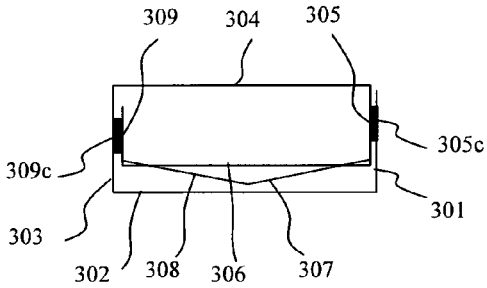
FIG. 7 is a top view of the first preferred embodiment of the packet.
Figure 8:
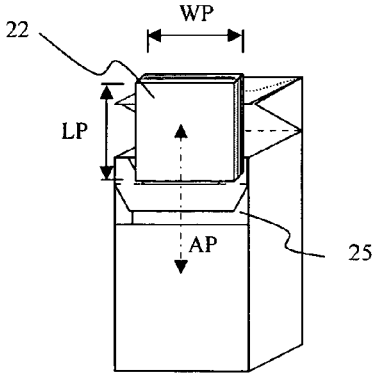
FIG. 8 shows how the second product can be placed in and taken out of the first preferred embodiment of the packet.
Figure 9:
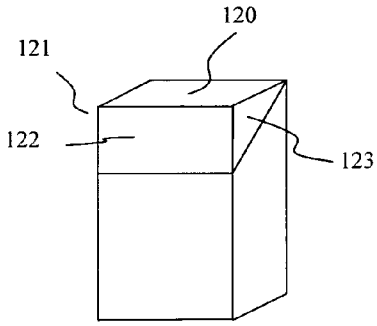
FIG. 9 illustrates the first preferred embodiment of the packet when fully finished.

FIG. 7 shows a top view of the pre-glued blank after it has been erected, that is to say, after folding the pre-glued blank in such a way that the sidewalls have the profile of the finished packet. The drawing highlights the gluing means 309*c* and 305*c* provided at the gluing zones 309*g* and 305*g*.

As illustrated, the container also comprises a bottom wall 105, defined by a rectangular panel 314 extending from a lower edge of the rear panel 304, connected to corresponding peripheral sidewalls 101, 103 through corresponding bottom tabs 311, 313, which extend from the lower edges of the side panels 301, 303, respectively, and which are joined by means of glue to the inside face of a tab 312 which in turn extends from the lower edge of the front wall 302.

As shown in FIG. 1, a suitable outlet opening for the first product 21 is provided at the top end of the box-shaped body 11, running parallel to the bottom wall and perpendicular to the sidewalls.

In a different embodiment, not illustrated, the top end of the box-shaped body is closed by a top wall formed by a set of panels extending from the sidewalls, and the outlet opening for the first product is obtained from a suitably shaped hole made in one of the two secondary sidewalls. In another embodiment, illustrated in FIG. 33, the top end of the box-shaped body is closed by a pair of panels extending from the sidewalls, and the outlet opening for the first product is obtained from a suitably shaped hole or cut made in the front wall.

Means are also advantageously provided for closing the first product outlet opening, these means being in the form of a respective lid 12 suitably connected to the box-shaped body 11 in such a way that it can swing. The lid 12 comprises a flat transversal wall 120, with a rectangular profile, whose peripheral edges, when the box is fully erected, are positioned substantially on the top edge of the sidewalls of the packet. This wall extends from the top edge of the rear wall 104.

The lid also comprises a front longitudinal wall 122 extending from the wall 120 on the side opposite the rear wall 104, and, when the lid is closed, overlapping the top end of the corresponding front wall 102 of the main body of the box.

The lid further comprises a first and a second peripheral sidewall 121, 123, extending from respective free edges of the top panel 120.

Suitable means are provided for connecting the lid 12 to the box-shaped body 10, said means comprising a crease line defining a hinge about which the lid can turn relative to the rear wall 104. Retaining means are also provided for keeping the lid 12 closed on the box-shaped body 11, these retaining means comprising engagement means, provided on the lid 12 and being in the form of a first and a second tooth 124, 125 extending from the corresponding peripheral walls 121, 123 and resting on the inside of the wall 122. The teeth on the lid act in conjunction with respective engagement means provided on the box-shaped body and comprising a tab 106, provided on the outside face of the front wall 102 and extending from the top edge of the front wall 102 itself. This type of closure, usually referred to as flip top by experts in the trade, is well known in the trade and its operating principle is therefore not further described.

Figure 2:
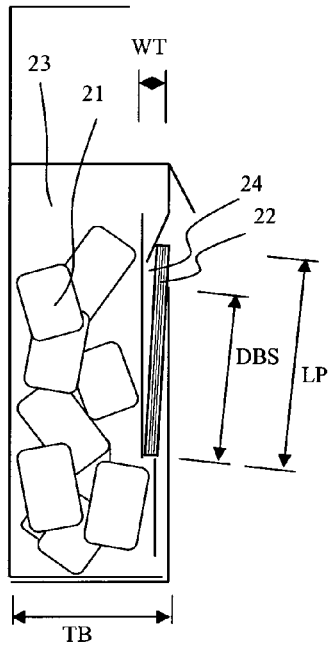
FIG. 2 illustrates the cross section through 'A-A' of the first preferred embodiment of the packet.

As may be clearly inferred from the cross section of FIG. 2, the packet 10 comprises a first containment zone 23 for containing a first product 21 and an internal compartment 24 for containing a second product 22 and formed on the inside of the peripheral walls 101,102,103,104 of the box-shaped body 11.

In this preferred embodiment, the internal compartment is in turn equipped with lateral containment means for the second product, in the form of a plurality of peripheral walls that delimit the internal compartment 24 itself. In an especially preferred embodiment, the compartment is rectangular in cross section.

In this embodiment, the internal compartment 24 has four peripheral inside walls, three of which, namely, the sidewall 101, the sidewall 103 and the front wall 102, are parts of the inside of the peripheral walls of the box-shaped body 11. The last wall of the compartment is formed by the panel 306, held in position relative to the other walls of the box-shaped body by the panels 305 and 309 between which it extends in the blank and which are suitably connected to the wall of the box shaped body by the gluing means 309*c* and 305*c*. In this embodiment, the width WA of the panel 305 is between 0.3 and 10 mm smaller than the thickness TB of the packet.

Figure 30:
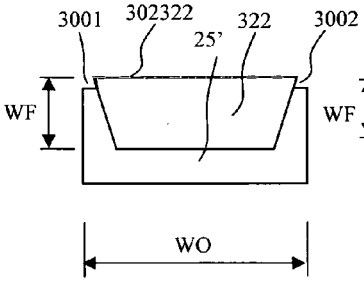
FIG. 30 illustrates a second preferred embodiment of the zone for dispensing the second product.
Figure 31:
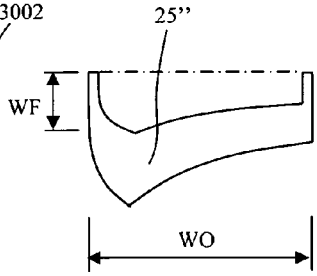
FIG. 31 illustrates a third preferred embodiment of the zone for dispensing the second product.
Figure 32:
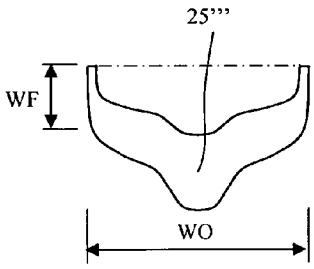
FIG. 32 illustrates a fourth preferred embodiment of the zone for dispensing the second product.

These measurements give the internal compartment a depth WT that is sufficient to contain the second product and occupies a minimum space inside the part of the packet designed to contain the first product. In this preferred embodiment, as shown in FIGS. 1 and 2, the first product 21 consists of a plurality of chewing gums, while the second product 22 is a group of paper pieces. According to advantageous aspects, the number of paper pieces is greater than or equal to the number of chewing gums minus one. As shown in FIG. 1, the packet comprises a zone 25 for dispensing the second product from the internal compartment through the front wall 102. As shown in FIGS. 3 and 4, the zone 25 for dispensing the second product is obtained from a shaped hole made in the panel 302 constituting the front wall 102, said hole being delimited by lines 302*a*, 302*b*, 302*c*, 302*d*, 302*e*, 302*f* for cutting the paperboard into a polygonal shape. We define as AP the axis lying in the plane of the wall on which the second product dispensing zone is made and obtained as the projection onto that wall of the line along which the second product is inserted and taken out. In similar embodiments, some of which are shown in FIGS. 30, 31 and 32, the second product dispensing zone is delimited by a series of cuts, that may be curved or straight as required, forming different shapes 25', whether symmetrical 25''' or asymmetrical 25'' about an axis parallel to AP.

In this first preferred embodiment, the second product dispensing zone extends for a width WO, being the maximum dimension measured on the plane of the wall on which the zone is formed, at right angles to the axis AP, equal to the width WB of the wall on which the second product dispensing zone is formed, measured at right angles to the axis AP. This width makes it easier to take out the second product without the risk of a corner of the second product remaining inside the packet. Also in this first preferred embodiment, the second product dispensing zone is completely inside the zone of the front wall corresponding to the front wall 122 of the lid 12. This solution enables the second product to be placed in the packet without making it visible to the user before the packet is opened for the first time. In this first preferred embodiment, too, at least one point of the boundary of the second product dispensing zone lies on the edge joining the front wall 102 to one of the two secondary sidewalls 101, 103.

The method of filling the packet comprises inserting the group of paper pieces through the same second product dispensing zone.

According to a first preferred filling method, first the second product is filled into the internal compartment through the second product dispensing zone and then the first product is placed in the packet. This method ensures that the first product does not exert pressure on the panel 306 which would reduce the space available for the second product. When there is no risk of this happening, a different filling method may be used.

Thus, in a second preferred filling method, the first product is filled into the packet and then the second product is filled into the internal compartment through the second product dispensing zone.

To enable the second product to be easily inserted into the internal compartment and taken out just as easily, means are provided for facilitating the insertion and removal of the second product through the second product dispensing zone. These means are embodied by a flap 322, obtained from the panel from which the second product dispensing zone is obtained through a crease or partial cutting line 302322.

This flap is therefore hinged to the wall from which the second product dispensing zone is obtained through the same crease line 302322.

As shown in FIG. 2, this enables the flap to go into the internal compartment during insertion of the second product and to remain behind the product in such a way as to create a guide to make it easier to take the product out.

To prevent the flap from folding inwards too far with respect to the outer wall on which it is made, making it awkward to take out the second product, the width WF of the flap, meaning the distance between the hinge line 302322 and the point furthest away from it on the flap along a line perpendicular to the hinge line itself, is 1.15 times greater than the depth WT of the internal compartment, meaning the distance between the wall 102 on which the second product dispensing zone is made and the opposite wall 306 of the internal compartment.

In this first preferred embodiment, the packet is provided with means for stopping the second product at the bottom of the internal compartment. These means are necessary to prevent the product from slipping out of the internal compartment 24 into the first containment zone 23 and are located in the part of the internal compartment furthest away from the second product dispensing zone along the line AP. These means also keep the second product in a position such that it can easily be taken out through the second product dispensing zone. For this purpose, as shown in FIG. 2, the distance DBS, meaning the minimum distance between the bottom stop means and the second product dispensing zone, is at least 3 millimeters less than the length LP of the second product, meaning the dimension of the second product in the direction in which it is inserted into the internal compartment. This difference enables the product to be picked between the fingers and taken out through the second product dispensing zone without having to move or pull open any parts of the box-shaped body.

In the first preferred embodiment, these means are obtained from two panels 307 and 308, divided from the panel 306 by a cutting line and connected to the respective panels 305 and 309 by crease or weakening lines. More specifically, the panel 307 is connected to the panel 305 by the crease line 3057, parallel to the crease line 3056 which connects the top of the panel 305 to the panel 306, but offset in the direction of the panel 305 by a value between 0 and 2 mm. In the same way, the panel 308 is connected to the panel 309 by the crease line 3089, parallel to the crease line 3069 which connects the top of the panel 306 to the panel 309, but offset in the direction of the panel 309 by a value between 0 and 2 mm. At least one of the two values must be greater than 0 so that the width of the pair of panels 307 and 308, meaning the distance between the crease lines 3057 and 3089, is greater than the width of the panel 306 by a value between 0.1 and 4 mm. This difference between the positions of the crease lines means that during erection of the packet the two panels 307 and 308 adopt an arcuate shape since they are longer than the corresponding wall 306.

The creation of a shaped line of weakening 3078 or of a crease line to divide the panels 307 and 308 enables the panels to adopt the shape of a broken line, as clearly shown in FIGS. 1 and 7. The two inclined planes cross the section of the internal compartment to form a support for the second product at least two points. In this first preferred embodiment, the packet is provided with means for stopping the second product at the top of the internal compartment.

If the packet is turned upside down, these means prevent the second product from sliding inside it so the second product is no longer at the correct height relative to the dispensing zone. They are located in the part of the internal compartment nearest the second product dispensing zone along the line AP. In this first preferred embodiment, these means are embodied by the flap 322 folded towards the inside of the internal compartment behind the second product. The flap thus prevents the second product from moving within the internal compartment in the direction opposite the stop means at the bottom. In an alternative embodiment, not illustrated, they are embodied in any of the ways used to make the bottom stop means.

In this first preferred embodiment, the packet is provided with retaining means for holding the second product within the packet. These means are necessary to prevent the second product from falling out if the packet is turned upside down.

In this first preferred embodiment, the retaining means are embodied by two retaining elements, the first being the flap 322 folded towards the inside of the internal compartment behind the second product. The flap exerts force on the second product and constrains it by friction against the inside of the wall 102 where the second product dispensing zone 25 is made, in such a way as to hold the product in place.

The second retaining element is the tab 106. This tab, used to engage the lid, is normally folded downwards, as shown in FIG. 2. In this position, the second product cannot come out of the internal compartment completely since the maximum distance between the crease line joining the tab 106 to the wall 102 and the second product dispensing zone along a line parallel to the axis AP is smaller than the length LP of the second product itself. In an alternative embodiment, shown in FIG. 30, the product retaining means are embodied by two teeth 3001 and 3002, one on each side of the flap 322 and extending from the hinge line 302322 towards the inside of the second product dispensing zone.

The distance between two teeth 3001 and 3002 is greater than or equal to the width WP of the second product, while the width WO of the second product dispensing zone is greater than the distance between the two teeth. With this configuration, to be able to take the second product out of the internal compartment, it must be centred between the teeth and then pulled out, thus making it difficult for it to fall out accidentally.

Figure 10:
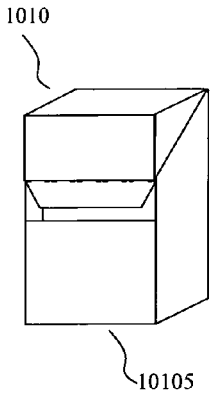
FIG. 10 illustrates a second preferred embodiment of the packet.
Figure 11:
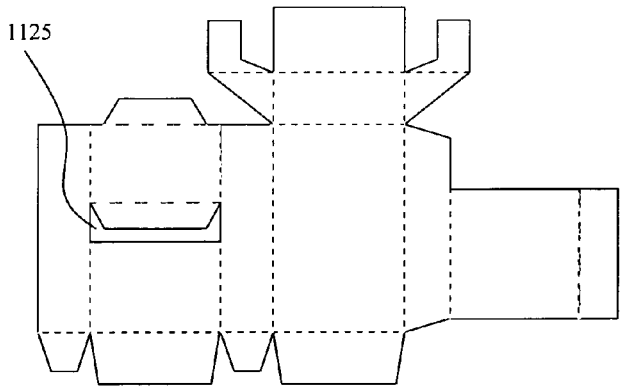
FIG. 11 is a plan view of the blank used to make the second preferred embodiment of the packet.

In yet another alternative embodiment, not illustrated, the product retaining means are obtained by making the depth WT of the internal compartment slightly smaller than the depth of the second product so that the deformation of the inside wall 304 holds the second product by friction against the inside of the opposite wall 302. FIGS. 10 and 11 illustrate a second preferred embodiment 1010 of the packet. Since this embodiment is very similar to the first, only the differences between it and the first embodiment are shown in the drawings and described.

In this embodiment, the second product dispensing zone 1125 is positioned at a distance from the bottom wall 10105 such that the wall itself constitutes the bottom stop means for the product. In this embodiment, too, the second product dispensing zone is not covered by the front wall of the lid, enabling the product to be taken out even without opening the lid. In a third preferred filling method, the second product is filled into the internal compartment through the second product dispensing zone after the packet has been filled with the first product and closed with the lid.

Figure 12:
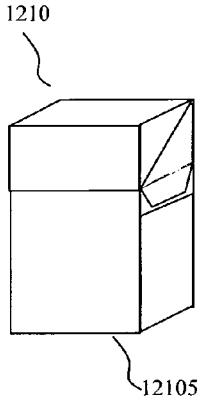
FIG. 12 illustrates a third preferred embodiment of the packet.
Figure 13:
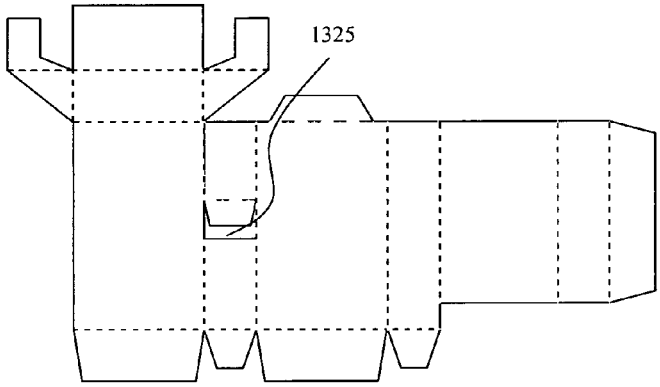
FIG. 13 is a plan view of the blank used to make the third preferred embodiment of the packet.
Figure 14:
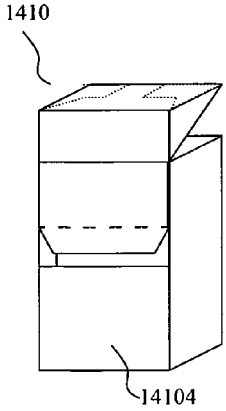
FIG. 14 illustrates a fourth preferred embodiment of the packet.
Figure 15:
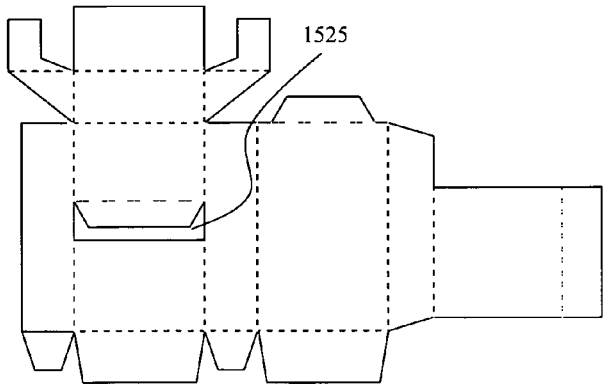
FIG. 15 is a plan view of the blank used to make the fourth preferred embodiment of the packet.

FIGS. 12 and 13 illustrate a third preferred embodiment 1210 of the packet. Since this embodiment is very similar to the first, only the differences between it and the first embodiment are shown in the drawings and described. In this embodiment, the second product dispensing zone 1325 is located on one of the two secondary lateral surfaces. This solution is useful, for example, if the second product is very narrow. In this embodiment, too, the means for stopping the product at the bottom of the packet are constituted by the bottom wall 12105 itself. FIGS. 14 and 15 illustrate a fourth preferred embodiment 1410 of the packet. Since this embodiment is very similar to the first, only the differences between it and the first embodiment are shown in the drawings and described. In this embodiment, the second product dispensing zone 1525 is located on the rear wall 14104. This solution is useful when the display front of the packet must not be spoiled.

A fifth preferred embodiment of the packet according to the invention is illustrated in FIGS. 16 to 20. This embodiment, very similar to the first, differs from the latter because, if the width WP of the second product is smaller than the width WB of the wall on which the second product dispensing zone is made, less material is required to make the internal compartment, thus achieving considerable savings.

Figure 17:
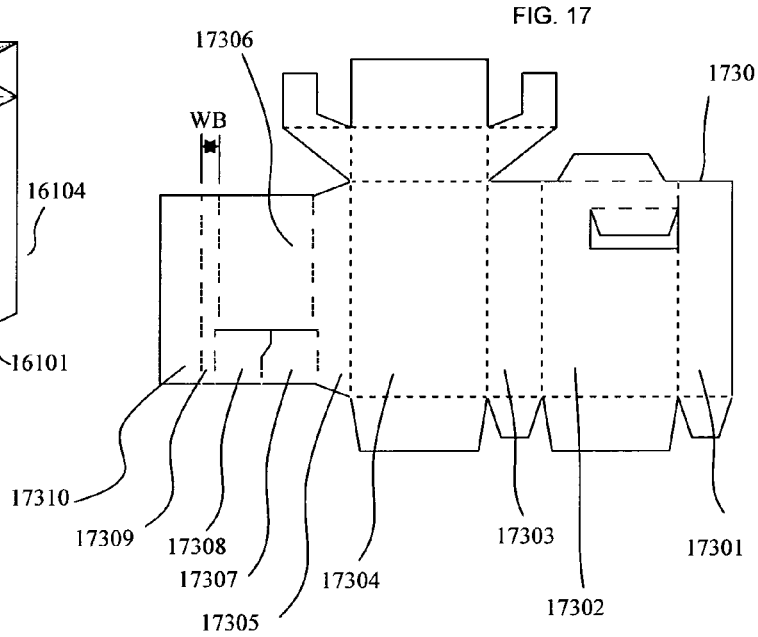
FIG. 17 is a plan view of the blank used to make the fifth preferred embodiment of the packet.
Figure 18:
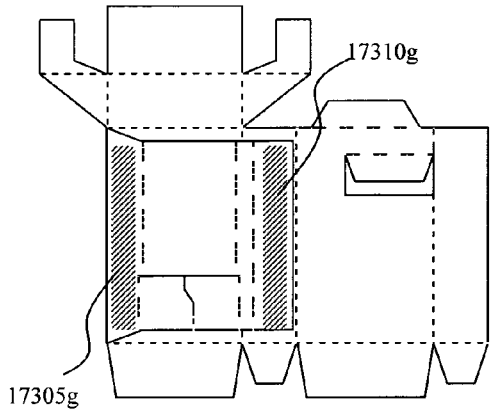
FIG. 18 is a plan view showing the blank used to make the fifth preferred embodiment of the packet, partly pre-folded before pre-gluing.
Figure 19:
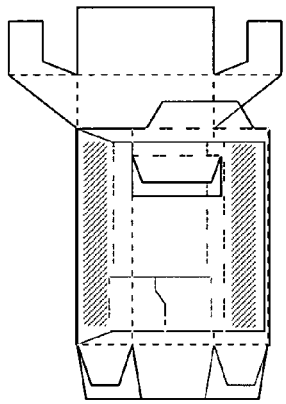
FIG. 19 is a plan view showing the blank used to make the fifth preferred embodiment of the packet when fully pre-glued.

This embodiment 1610 of the packet is obtained from the blank 1730 shown in FIG. 17, by suitably folding the blank and gluing the panel 17301 to the corresponding gluing zone 17305*g* on the back of the panel 17305, and the panel 17302 to the corresponding gluing zone 17310*g* on the back of the panel 17310.

Figure 20:
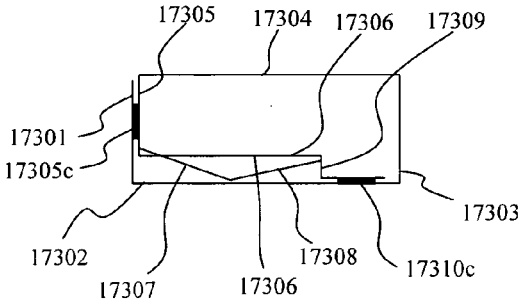
FIG. 20 is a top view of the fifth preferred embodiment of the packet.
Figure 21:
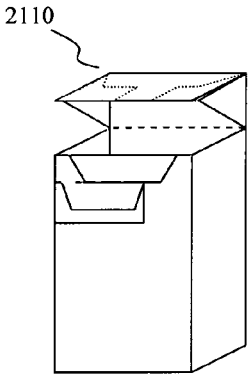
FIG. 21 illustrates a sixth preferred embodiment of the packet.

The panel 17302 forms the front wall 16102, the panel 17303 forms the sidewall 16103 and the panel 17304 forms the rear wall 16104, while the sidewall 16101 is formed by the two panels 17301 and 17305 joined to each other by the gluing means 17305*c*. FIG. 20 shows a top view of the pre-glued blank after it has been erected, and highlights the gluing means 17305*c* and 17310*c* provided at the gluing zones 17305*g* and 17310*g*.

In this embodiment, the internal compartment for containing the second product 22 has four peripheral inside walls, two of which, namely, the sidewall 16101 and the front wall 16102, are parts of the inside of the peripheral walls of the box-shaped body 11. The other two walls of the compartment are formed by the panel 17306 and by the panel 17309, held in position relative to the other walls of the box-shaped body by the panels 17305 and 17310, respectively, between which they extend in the blank and which are suitably connected to the wall of the box shaped body by the gluing means 17305*c* and 17310*c*. In this embodiment, the width WB of the panel 17309 is between 0.3 and 10 mm. These measurements give the internal compartment a depth WT that is sufficient to contain the second product and occupies a minimum space inside the part of the packet designed to contain the first product. The relation between the dimensions and position of the panels 17307 and 17308 forming the bottom stop means is identical to that of the corresponding panels 307 and 308 of the first preferred embodiment. FIGS. 21 to 25 show a sixth preferred embodiment 2110 of the packet, differing from the previous embodiment in the bottom stop means.

Figure 22:
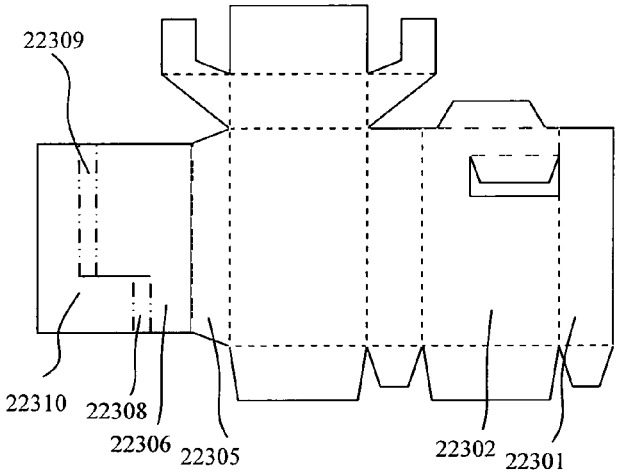
FIG. 22 is a plan view of the blank used to make the sixth preferred embodiment of the packet.
Figure 23:
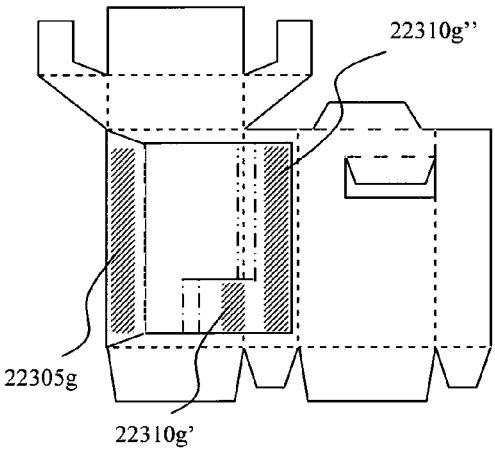
FIG. 23 is a plan view showing the blank used to make the sixth preferred embodiment of the packet, partly pre-folded before pre-gluing.
Figure 24:
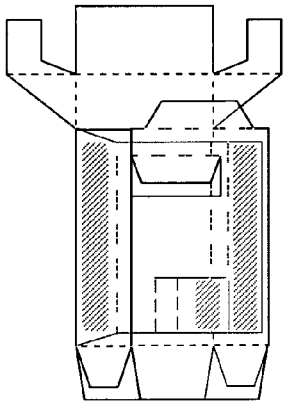
FIG. 24 is a plan view showing the blank used to make the sixth preferred embodiment of the packet when fully pre-glued.

This embodiment of the packet can be obtained from the blank 2230 illustrated in FIG. 22.

In this case, too, the pre-glued blank is obtained by suitably folding the blank and gluing the panel 22301 to the corresponding gluing zone 22305*g* on the back of the panel 22305, and the panel 22302 to the corresponding gluing zone 22310*g*" on the back of the panel 22310. To further improve the packet, the panel 22302 can be glued to the second corresponding gluing zone 22310*g*', also located on the back of the panel 22310.

Figure 25:
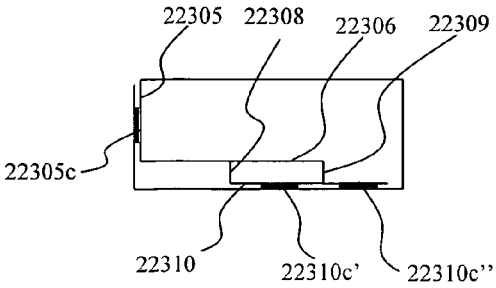
FIG. 25 is a top view of the sixth preferred embodiment of the packet.

FIG. 25 shows a top view of the pre-glued blank after it has been erected, and highlights the gluing means 22305*c* 22310*c*' and 22310*c*" provided at the gluing zones 22305*g*, 22310*g*' and 22310*g*". In a second embodiment, not shown in the drawing, the means 22310*c*' are not applied. During erection of the pre-glued blank, since the two panels 22307 and 22308 are substantially the same in width, a sequence of panels is obtained such that the panel 22307 is positioned at right angles to the panel 22306 from which it is detached to form the means for stopping the second product at the bottom of the internal compartment. In an especially preferred embodiment, shown in FIG. 25, the panel 22306 is positioned approximately in the middle of the internal compartment.

Figure 26:
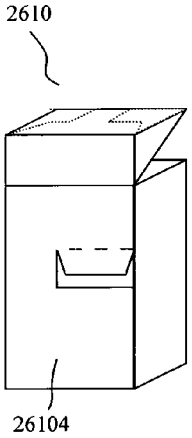
FIG. 26 illustrates a seventh preferred embodiment of the packet.
Figure 27:
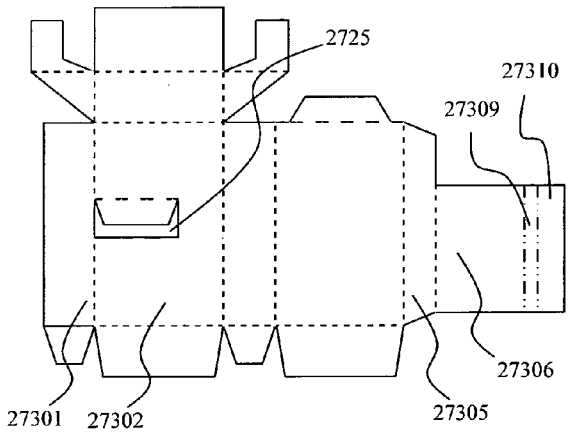
FIG. 27 is a plan view of the blank used to make the seventh preferred embodiment of the packet.

FIG. 26 shows a seventh preferred embodiment 2610 of the packet and FIG. 27 shows the blank from which this embodiment is made.

This embodiment is substantially equivalent to the embodiment 1410 illustrated in FIG. 14, from which it differs in that the width of the second product dispensing zone 2725 is smaller than the width of the rear panel 26104 from which the dispensing zone is obtained. As regards the construction of the internal compartment with the panels 27301, 27302, 27305, 27306, 27309, 27310, this embodiment is much the same as the fifth preferred embodiment where the compartment is made with the corresponding panels 17301, 17302, 17305, 17306, 17309, 17310.

Figure 28:
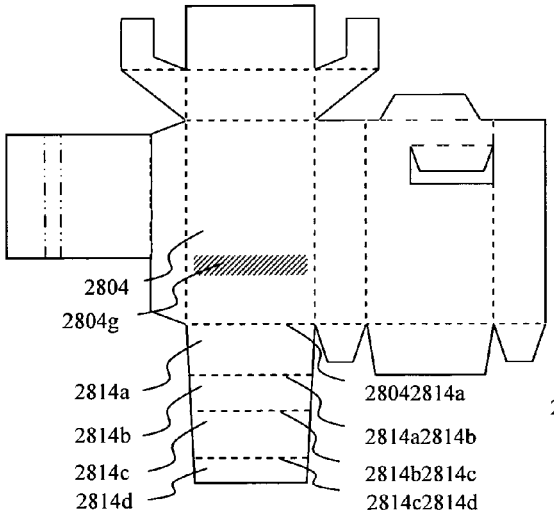
FIG. 28 is a plan view of the blank used to make an eighth preferred embodiment of the packet.
Figure 29:
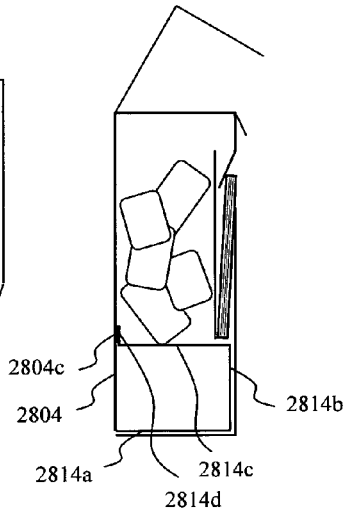
FIG. 29 illustrates a cross section of the eighth preferred embodiment of the packet.

FIG. 28 shows the blank used to make an eighth preferred embodiment 2910 of the packet, illustrated in cross section in FIG. 29.

Figure 16:
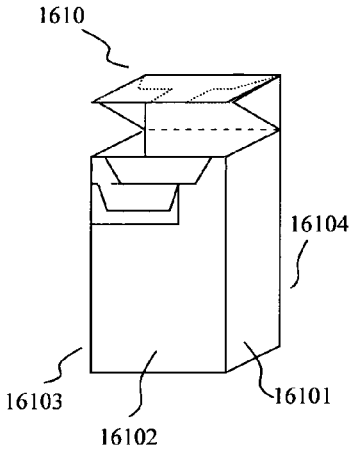
FIG. 16 illustrates a fifth preferred embodiment of the packet.

This embodiment is substantially the same as the fifth embodiment 1610 illustrated in FIGS. 16 and 17, from which it differs in the stop means at the bottom of the packet. Thus, in this embodiment, these stop means are formed by a series of panels 2814*a*, 2814*b*, 2814*c*, 2814*d* which extend from the lower edge of the rear lateral panel 2804. This panel is provided with a gluing zone 2804*g*, to which the panel 2814*d* is attached by suitable gluing means 2804*c*. During folding of the panel 2814*a* to close the bottom of the box-shaped body, the panels, thanks to their special geometry, that is to say, the distance between the crease line 2814*c*2814*d* and the crease line 28042814*a* once the panel 2814*d* has been glued to the panel 2804, which is substantially the same as the distance between the crease lines 2814*b*2814*c* and 2814*a*2814*b*, form a surface parallel to the bottom wall, comprised of the panel 2814*c* held in position by the two panels 2814*d* and 2814*b*.

Figure 33:
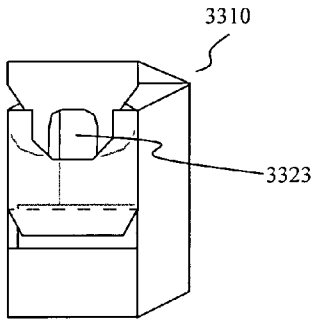
FIG. 33 illustrates a ninth preferred embodiment of the packet.
Figure 34:
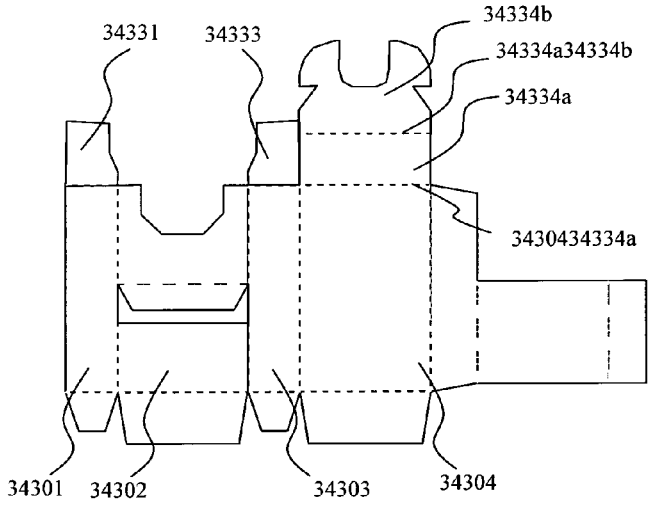
FIG. 34 is a plan view of the blank used to make the ninth preferred embodiment of the packet.

FIG. 33 illustrates a ninth alternative embodiment 3310 of the packet, substantially equivalent to the second embodiment 1010 illustrated in FIG. 10, from which it differs in the means for closing the top end of the box-shaped body and in the position of the first product outlet.

Figure 35:
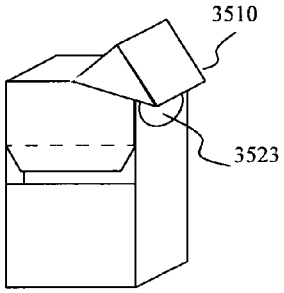
FIG. 35 illustrates a tenth preferred embodiment of the packet.

More specifically, the closing means are obtained from a pair of panes 34334*a*, 34334*b* extending from the rear panel 34304 and hinged along the crease line 3430434334*a* and which interact with a pair of panels 34331, 34333 that extend from the upper edges of the secondary side panels 34301 and 34303 in a manner well known to experts in the trade. This type of closure, known as "tuck flap", makes it possible, to obtain a product outlet opening 3323 for the first product on the front wall 34302 of the packet, as in the case of FIG. 33. In an alternative embodiment, the front wall of the packet does not have any cut out zone for taking out the first product which must be taken out through the top of the packet, as in the other embodiments described above. FIG. 35 illustrates a tenth alternative embodiment 3510 of the packet, substantially equivalent to the second embodiment 1010 illustrated in FIG. 10, from which it differs in the means for closing the top end of the box-shaped body and in the position of the first product outlet.

Figure 36:
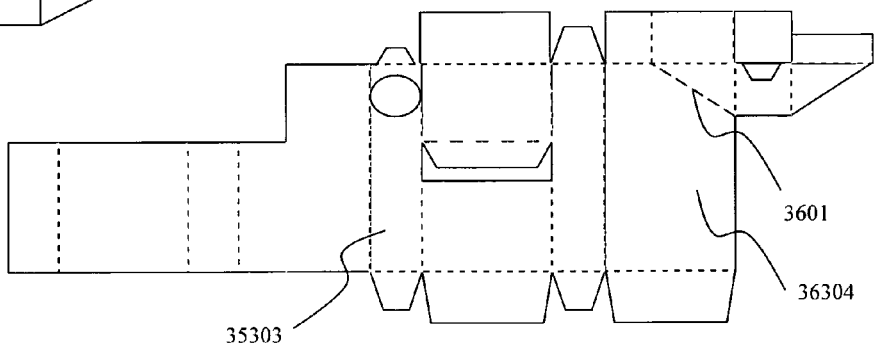
FIG. 36 is a plan view of the blank used to make the tenth preferred embodiment of the packet.

More specifically, the closing means are obtained from a series of panels suitably connected to the walls of the packet and partially obtained from the panel 36304 through a pre-cut line 3601 as shown in FIG. 36 and connected to each other according to known methods. This type of closure, known as "side flip top", makes it possible to obtain a product outlet opening 3523 for the first product on the sidewall wall 35303 of the packet, as shown in FIG. 35. The invention thus provides a packet which can contain different products simultaneously and which has a simple system for holding the second product within the packet while at the same time making it available for use when required. The amount of packaging material used to make the packet is minimal.

The packets illustrated herein are used for descriptive purposes only without limiting the field of application of the invention.

Modifications and extensions may be developed on the basis of the teachings hereof and of the current state of the art and such modifications and extensions are deemed to be within the scope of this present invention.

The invention claimed is:

1. A packet, comprising:

a box-shaped outer container body made of paperboard or other foldable material;

a first product that is chewing gum inside the outer container body;

second product comprising a plurality of paper pieces;

a plurality of walls forming said container body;

an internal compartment formed on an inside of said plurality of walls designed to contain the second product;

a second product dispensing zone provided for dispensing the second product from the internal compartment through one of the walls of the outer container body; and a flap configured for facilitating insertion and removal of the second product through the second product dispensing zone, said flap being hinged to the wall on which the second product dispensing zone is formed and said flap, when the second product is inside the internal compartment, is in contact with a side of the second product that shows through the second product dispensing zone.

2. The packet according to claim 1, wherein the outer container body comprises a single piece of foldable material.

3. The packet according to claim 1, wherein at least part of the inside of at least one of the walls of the box-shaped body forms one side of the internal compartment.

4. The packet according to claim 1, wherein the outer container body comprises a plurality of peripheral walls that delimit a box-shaped body and the second product dispensing zone is obtained from a shaped hole made in a respective peripheral wall.

5. The packet according to claim 1, wherein the outer container body comprises at least two main sidewalls, namely a front wall and a rear wall, opposite to each other and larger or equal in area to at least two secondary, left- and right-hand sidewalls which permanently join the front wall to the rear wall.

6. The packet according to claim 5, wherein the second product dispensing zone is obtained from a shaped hole made in the front wall.

7. The packet according to claim 5, wherein the second product dispensing zone is obtained from a shaped hole made in the rear wall.

8. The packet according to claim 5, wherein the second product dispensing zone is obtained from a shaped hole made in one of the secondary sidewalls.

9. The packet according to claim 1, wherein the outer container body comprises means for facilitating the insertion and removal of the second product through the second product dispensing zone.

10. The packet according to claim 1, wherein the outer container body comprises means for stopping the second product at the bottom of the internal compartment.

11. The packet according to claim 10, wherein the means for stopping are embodied by at least one panel for closing the bottom wall of the container body.

12. The packet according to claim 10, wherein the means for stopping are embodied by two panels which are not at right angles to the sidewalls of the internal compartment.

13. The packet according to claim 1, wherein the outer container body comprises a bottom wall.

14. The packet according to claim 1, wherein the outer container body comprises means for stopping the second product at a top of the internal compartment.

15. The packet according to claim 1, wherein the outer container body comprises retaining means for holding the second product within the internal compartment.

16. The packet according to claim 15, wherein the retaining means stop the product by friction.

17. The packet according to claim 15, wherein two teeth formed on the wall on which the second product dispensing zone is formed and located on an edge of the second product dispensing zone at a distance from each other.

18. The packet according to claim 1, wherein the outer container body is provided with a lid and wherein the lid prevents the first product from falling out.

* * * * *